US011466687B2

(12) United States Patent
Hirayama

(10) Patent No.: US 11,466,687 B2
(45) Date of Patent: Oct. 11, 2022

(54) ROTARY COMPRESSOR AND REFRIGERATION CYCLE APPARATUS

(71) Applicant: Toshiba Carrier Corporation, Kawasaki (JP)

(72) Inventor: Takuya Hirayama, Fuji (JP)

(73) Assignee: TOSHIBA CARRIER CORPORATION, Kawasaki (JP)

( * ) Notice: Subject to any disclaimer, the term of this patent is extended or adjusted under 35 U.S.C. 154(b) by 116 days.

(21) Appl. No.: 17/033,363

(22) Filed: Sep. 25, 2020

(65) Prior Publication Data

US 2021/0054842 A1 Feb. 25, 2021

Related U.S. Application Data

(63) Continuation of application No. PCT/JP2018/012424, filed on Mar. 27, 2018.

(51) Int. Cl.
*F04C 18/356* (2006.01)
*F04C 28/02* (2006.01)
*F04C 23/00* (2006.01)

(52) U.S. Cl.
CPC ..... *F04C 18/3564* (2013.01); *F04C 2210/24* (2013.01); *F04C 2240/20* (2013.01); *F04C 2240/60* (2013.01); *F04C 2240/804* (2013.01)

(58) Field of Classification Search
CPC .. F04C 18/3564; F04C 28/02; F04C 2240/60; F04C 23/001; F04C 18/356
See application file for complete search history.

(56) References Cited

U.S. PATENT DOCUMENTS 6,318,981 B1 * 11/2001 Ebara ..... F04C 11/001 418/11
8,182,253 B2 * 5/2012 Hirayama ..... F04C 18/356 418/150
2010/0147013 A1 6/2010 Hirayama
(Continued)

FOREIGN PATENT DOCUMENTS

CN 1950611 A 4/2007
CN 103089631 A 5/2013
(Continued)

OTHER PUBLICATIONS

International Search Report dated Jun. 26, 2018 in connection with PCT International Application No. PCT/JP2018/012424.
(Continued)

*Primary Examiner* — Deming Wan
(74) *Attorney, Agent, or Firm* — John P. White

(57) ABSTRACT

According to one embodiment, a rotary shaft of a rotary compressor includes a first connection shaft and a second connection shaft. The first connection shaft has a cross-sectional shape including a first outer surface, a second outer surface, and a third outer surface. L1 represents a distance from an intersecting point located on one end side where the first outer surface and the second outer surface intersect each other to the rotation center, L2 represents a distance from an intersecting point located on an other end side where the first outer surface and the second outer surface intersect each other, to the rotation center, and L3 represents a distance from the third outer surface to the rotation center, a relationship of L1>L3≥L2 is satisfied.

10 Claims, 6 Drawing Sheets

(56) References Cited

U.S. PATENT DOCUMENTS

| | | | | |
|---|---|---|---|---|
| 2017/0167487 | A1 | 6/2017 | Nakai et al. | |
| 2020/0132071 | A1* | 4/2020 | Adachi | F04C 23/001 |

FOREIGN PATENT DOCUMENTS

| | | | |
|---|---|---|---|
| CN | 104963864 | A | 10/2015 |
| CN | 106030113 | A | 10/2016 |
| JP | H6-10863 | A | 1/1994 |
| JP | 2010-71265 | A | 4/2010 |
| JP | 4594302 | B2 | 12/2010 |
| JP | 5117503 | B2 | 1/2013 |
| JP | 2013-96280 | A | 5/2013 |
| JP | 5441982 | B2 | 3/2014 |
| WO | WO 2009/028633 | A1 | 3/2009 |
| WO | WO 2015/198539 | A1 | 12/2015 |

OTHER PUBLICATIONS

Official action (and English translation) dated Nov. 19, 2021 from CNIPA (China National Intellectual Property Administration) in corresponding Chinese Patent Application.

* cited by examiner

ROTARY COMPRESSOR AND REFRIGERATION CYCLE APPARATUS

CROSS-REFERENCE TO RELATED APPLICATIONS

This application is a Continuation Application of PCT Application No. PCT/JP2018/012424, filed Mar. 27, 2018, the entire contents of which are incorporated herein by reference.

FIELD

Embodiments described herein relate generally to a multi-cylinder rotary compressor and a refrigeration cycle apparatus comprising the rotary compressor.

BACKGROUND

Recently, a 3-cylinder rotary compressor is developed, in which three sets of refrigerant compression units are arranged in an axial direction of the rotary shaft to raise compression ability of the refrigerant. The rotary shaft used for a rotary compressor of this type comprises first to third crank portions which eccentrically rotate in a cylinder chamber of the refrigerant compression unit, and a pair of connection shafts provided across between the first crank portion and the second crank portion and between the second crank portion and the third crank portion, respectively.

With the above-described structure, in the 3-cylinder rotary compressor, the full length of the entire rotary shaft is increased and the distance between a pair of bearings which support the rotary shaft is elongated as compared to the case of 2-cylinder rotary compressors in which two sets of refrigerant compression units are arranged in the axial direction of the rotary shaft. Therefore, in order to suppress wobbling of the rotary shaft when rotating at high speed, it is necessary to raise the rigidity of the connection shafts located between the first to third crank portions, respectively.

Under these circumstances, to raise the rigidity of the connecting shaft portion of the rotary shaft, conventionally, there is an attempt in which the cross-sections of the connection shafts are formed into such a shape that a pair of circular arcs are combined together.

DETAILED DESCRIPTION

Figure 1:
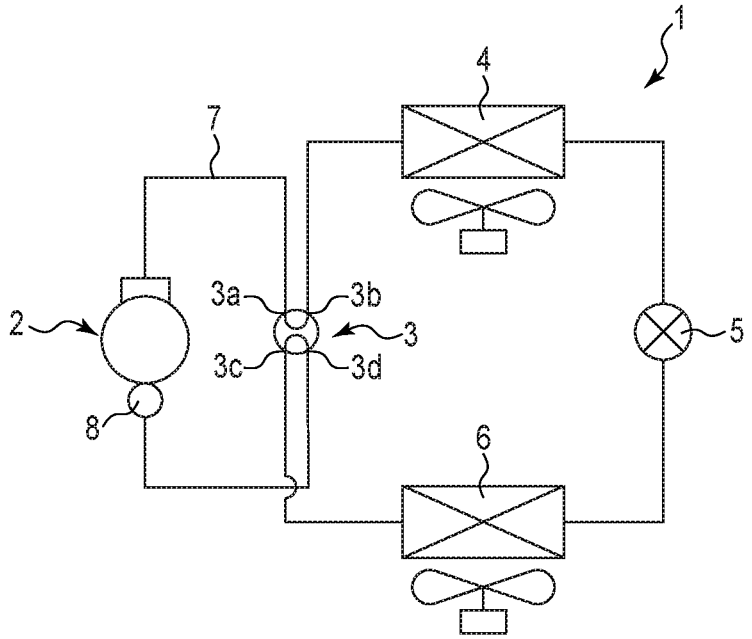
FIG. 1 is a circuit diagram briefly showing a structure of a refrigeration cycle apparatus according to an embodiment.

On the other hand, it is desirable in 3-cylinder rotary compressors that the eccentric direction of crank portions adjacent to each other should be shifted by 120° in the circumferential direction of the rotary shaft in order to suppress the fluctuation of torque, which may occur when the three sets of refrigerant compression units compress the refrigerant.

However, in a rotary shaft comprising connecting shaft portions whose cross-sections of the connection shafts are formed into such a shape that a pair of circular arcs are combined together, when the eccentric direction of crank portions adjacent to each other is set to be shifted by 120° in the circumferential direction of the rotary shaft, it is unavoidable that of two intersecting points of a pair of circular arcs, a difference occurs between the distance from the center of rotation of the rotary shaft to one intersecting point and the distance from the center of rotation of the rotary shaft to the other intersecting point.

As a result, the position of the center of gravity of the rotary shaft is shifted from the center of rotation of the rotary shaft towards the diametrical direction, and the balance of the rotary shaft deteriorates. The rotary shaft, when unbalanced, causes promotion of vibration of the 3-cylinder rotary compressor.

An object of the embodiments is to obtain a rotary compressor which can achieve less vibration and low noise by maintain the balance of the rotary shaft well while retaining the rigidity of the connecting shaft portion of the rotary shaft.

In general, according to one embodiment, a rotary compressor comprises:

a rotary shaft including a first journal portion supported by a first bearing, a second journal portion provided coaxial with the first journal portion and supported by a second bearing, first to third crank portions provided between the first journal portion and the second journal portion, arranged along an axial direction of the journal portions with intervals respectively therebetween and having circular cross sectional shapes whose eccentric directions are shifted in a circumferential direction of the journal portions, a first connection shaft provided across between the first crank portion and the second crank portion, and a second connection shaft provided across between the second crank portion and the third crank portion, which are integrated as one body, eccentric directions of adjacent pairs of the crank portions being shifted with respect to a rotation center of the journal portions in a circumferential direction within a range of 120°±10°;

ring-like rollers engaged with outer circumferential surfaces of the first to third crank portions, respectively;

a first cylinder body accommodating the respective roller engaged with the first crank portion, and the respective roller defining a first cylinder chamber which eccentrically rotates with the first crank portion;

a second cylinder body accommodating the respective roller engaged with the second crank portion, and the respective roller defining a second cylinder chamber which eccentrically rotates with the second crank portion;

a third cylinder body accommodating the respective roller engaged with the third crank portion, and the respective roller defining a third cylinder chamber which eccentrically rotates with the third crank portion;

a first intermediate partition plate interposed between the first cylinder body and the second cylinder body, in which a first connection shaft of the rotary shaft penetrates; and a second intermediate partition plate interposed between the second cylinder body and the third cylinder body, in which a second connection shaft of the rotary shaft penetrates.

The first connection shaft of the rotary shaft has a cross sectional shape comprising a first outer surface formed in a position same as an outer circumferential surface of the first crank portion located on an opposite side to the eccentric direction of the first crank portion or a position shifted to a side of the rotation center of the rotary shaft as compared to the outer circumferential surface, at least a middle portion thereof being formed into an arc shape, a second outer surface formed in a position same as an outer circumferential surface of the second crank portion located on an opposite side to the eccentric direction of the second crank portion or a position shifted to a side of the rotation center of the rotary shaft as compared to the outer circumferential surface, at least a middle portion thereof being formed into an arc shape and a third outer surface formed across between the first outer surface and the second outer surface in a position shifted from the rotation center of the rotary shaft.

When, in a cross section normal to the axial direction of the rotary shaft of the first connection shaft, L1 represents a distance from an intersecting point located on one end side where the first outer surface and the second outer surface intersect each other when the first outer surface and the second outer surface are extended, to the rotation center of the rotary shaft, L2 represents a distance from an intersecting point located on an other end side where the first outer surface and the second outer surface intersect each other, to the rotation center of the rotary shaft, and L3 represents a distance from the third outer surface to the rotation center of the rotary shaft, a relationship of $L1>L3\geq L2$ is satisfied.

Embodiments will be described below with reference to FIGS. 1 to 8.

FIG. 1 is a circuit diagram of a refrigerating cycle of an air conditioner 1, which is an example of the refrigeration cycle apparatus. The air conditioner 1 comprises a rotary compressor 2, a four-way valve 3, an outdoor heat exchanger 4, an expansion device 5 and an indoor heat exchanger 6 as main structural elements. These elements which constitutes the air conditioner 1 are connected via a circulation circuit 7 in which a refrigerant circulates through.

More specifically, as shown in FIG. 1, a discharge side of the rotary compressor 2 is connected to a first port 3*a* of the four-way valve 3. A second port 3*b* of the four-way valve 3 is connected to the outdoor heat exchanger 4. The outdoor heat exchanger 4 is connected to the indoor heat exchanger 6 via the expansion device 5. The indoor heat exchanger 6 is connected to a third port 3*c* of the four-way valve 3. A fourth port 3*d* of the four-way valve 3 is connected to an intake side of the rotary compressor 2 via an accumulator 8.

When the air conditioner 1 is driven by a cooling mode, the four-way valve 3 switches over so that the first port 3*a* communicates to the second port 3*b* and the third port 3*c* communicates to the fourth port 3*d*. When the cooling mode operation of the air conditioner 1 is started, a high-temperature and high-pressure vapor-phase refrigerant compressed by the rotary compressor 2 is guided via the four-way valve 3 to the outdoor heat exchanger 4 which functions as a radiator (condenser).

The vapor-phase refrigerant guided to the outdoor heat exchanger 4 is condensed by heat exchange with the air, and it is transformed into a high-pressure liquid-phase refrigerant. The high-pressure liquid-phase refrigerant is depressurized while passing through the expansion device 5 and is transformed into a low-pressure gas-liquid two-phase refrigerant. The gas-liquid two-phase refrigerant is guided to the indoor heat exchanger 6 which functions as a heat absorber (evaporator) and heat-exchanges with air while passing through the indoor heat exchanger 6.

As a result, the gas-liquid two-phase refrigerant takes heat from the air and evaporates to be transformed into a low-temperature and low-pressure vapor-phase refrigerant. The air passing through the indoor heat exchanger 6 is cooled by latent heat of the vaporization of the liquid-phase refrigerant and is sent as cool wind to a place to be air conditioned (cooled).

The low-temperature and low-pressure vapor-phase refrigerant which has passed the indoor heat exchanger 6 is guided to the accumulator 8 via the four-way valve 3. When a liquid-phase refrigerant portion which has not evaporated is contained in the refrigerant, the liquid-phase refrigerant and the vapor-phase refrigerant are separated from each other by the accumulator 8. The low-temperature and low pressure vapor-phase refrigerant, form which the liquid-phase refrigerant has been separated, is suctioned into the rotary compressor 2, where it is compressed again into a high-temperature and high pressure vapor-phase refrigerant, and then is discharged to the circulation circuit 7.

On the other hand, when the air conditioner 1 is driven by a heating mode, the four-way valve 3 switches over so that the first port 3*a* communicates to the third port 3*c* and the second port 3*b* communicates to the fourth port 3*d*. Thus, the high-temperature and high-pressure vapor-phase refrigerant discharged from the rotary compressor 2 is guided via the four-way valve 3 to the indoor heat exchanger 6, where the refrigerant heat-exchanges with the air passing through the indoor heat exchanger 6. In other words, the indoor heat exchanger 6 functions as a condenser.

As a result, the vapor-phase refrigerant passing though the indoor heat exchanger 6 is condensed by the heat exchange with the air, and transformed into a high-pressure liquid-phase refrigerant. The air passing through the indoor heat exchanger 6 is heated by the heat exchange with the vapor-phase refrigerant to be warm air and sent to the place to be air-conditioned (heated).

The high temperature liquid-phase refrigerant having passed the indoor heat exchanger 6 is guided to the expansion device 5 and depressurized while passing through the expansion device 5 and is transformed into a low-pressure gas-liquid two-phase refrigerant. The gas-liquid two-phase refrigerant is guided to the outdoor heat exchanger 4, which functions as an evaporator, and is evaporated here by heat-exchanging with the air to be transformed into a low-temperature and low-pressure vapor-phase refrigerant. The low-temperature and low-pressure vapor-phase refrigerant having passed the outdoor heat exchanger 4 is suctioned into the rotary compressor 2 via the four-way valve 3 and the accumulator 8.

Figure 2:
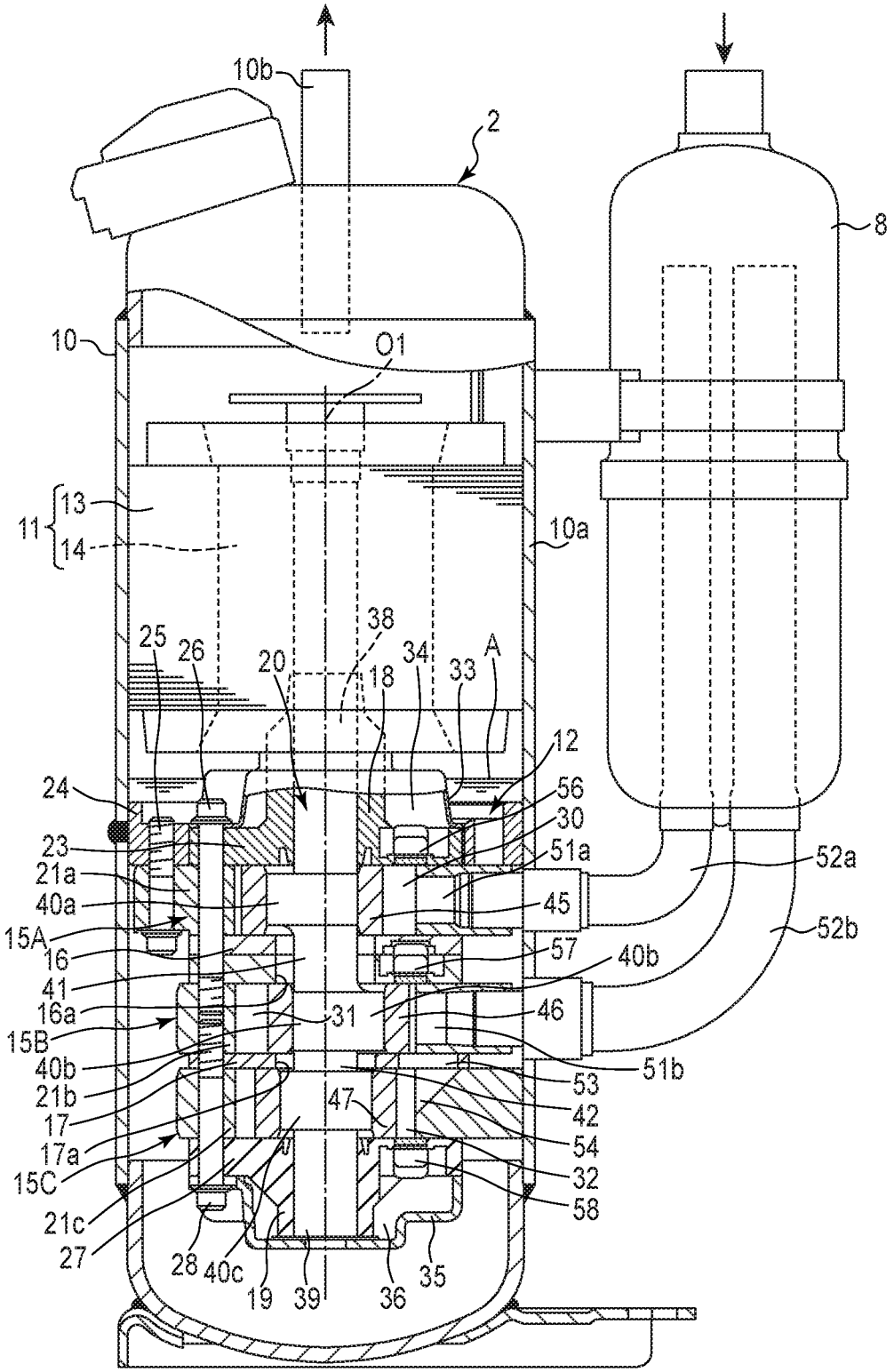
FIG. 2 is a cross section of a 3-cylinder rotary compressor of the embodiment.

Then, a concrete structure of the rotary compressor 2 used for the air conditioner 1 will be described with reference to FIGS. 2 to 8. FIG. 2 is a cross section of the 3-cylinder rotary compressor 2 in a vertical form. As shown in FIG. 2, the 3-cylinder rotary compressor 2 includes a sealed container 10, an electric motor 11 and a compression mechanism unit 12 as main structural elements.

The sealed container 10 includes a cylindrical circumferential wall 10*a* and is disposed stand up along the vertical direction. A discharge pipe 10*b* is provided in an upper end portion of the sealed container 10. The discharge pipe 10*b* is connected to the first port 3*a* of the four-way valve 3 via the circulation circuit 7. Furthermore, a lubricating oil for lubricating the compression mechanism unit 12 is reserved in a lower portion of the sealed container 10.

The electric motor 11 is accommodated in an axial middle portion of the sealed container 10 so as to be located above a surface level A of the lubricant oil. The electric motor 11 is the so-called inner rotor motor and comprises a stator 13 and a rotor 14. The stator 13 is fixed on an inner surface of the circumferential wall 10*a* of the sealed container 10. The rotor 14 is located to be coaxial with the sealed container 10 on a central axis O1 thereof and is surrounded by the stator 13.

Figure 3:
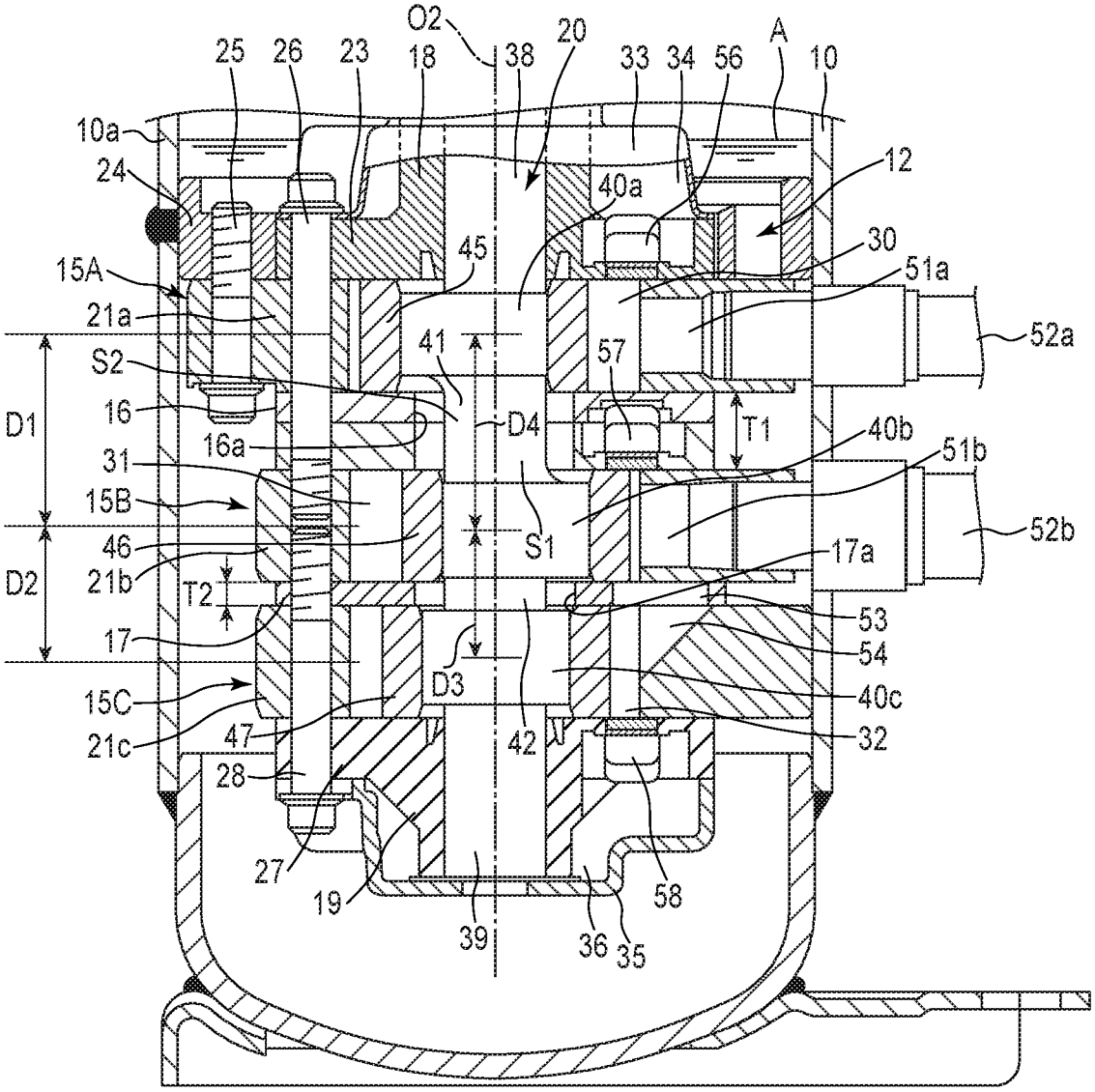
FIG. 3 is an enlarged cross section of a compression mechanism unit of the 3-cylinder rotary compressor of the embodiment.

The compression mechanism unit 12 is accommodated in the lower portion of the sealed container 10 to be immersed in the lubricant oil. As shown in FIGS. 2 and 3, the compression mechanism unit 12 comprises a first refrigerant compression unit 15A, a second refrigerant compression unit 15B, a third refrigerant compression unit 15C, a first intermediate partition plate 16, a second intermediate partition plate 17, a first bearing 18, a second bearing 19 and a rotary shaft 20 as main structural elements.

The first to third refrigerant compression units 15A, 15B and 15C are arranged in a single row along the axial direction of the sealed container 10 with intervals respectively therebetween. The first to third refrigerant compression units 15A, 15B and 15C include a first cylinder body 21*a*, a second cylinder body 21*b* and a third cylinder body 21*c*, respectively. The first to the third cylinder bodies 21*a*, 21*b* and 21*c* are set to have the same thickness along the axial direction of the sealed container 10, for example.

The first intermediate partition plate 16 is interposed between the first cylinder body 21*a* and the second cylinder body 21*b*. An upper surface of the first intermediate partition plate 16 is overlaid on a lower surface of the first cylinder body 21*a* so as to cover an inner diameter portion of the first cylinder body 21*a* from below. A lower surface of the first intermediate partition plate 16 is overlaid on an upper surface of the second cylinder body 21*b* so as to cover an inner diameter portion of the second cylinder body 21*b* from above.

Further, a circular through hole 16*a* is formed in a central portion of the first intermediate partition plate 16. The through hole 16*a* is located between the inner diameter portion of the first cylinder body 21*a* and the inner diameter portion of second cylinder body 21*b*.

The second intermediate partition plate 17 is interposed between the second cylinder body 21*b* and the third cylinder body 21*c*. The upper surface of the second intermediate partition plate 17 is overlaid on a lower surface of second cylinder body 21*b* so as to cover the inner diameter portion of the second cylinder body 21*b* from below. The lower surface of the second intermediate partition plate 17 is overlaid on an upper surface of the third cylinder body 21*c* so as to cover an inner diameter portion of the third cylinder body 21*c* from above.

Further, a circular through hole 17*a* is formed in a central portion of the second intermediate partition plate 17. The through hole 17*a* is located between the inner diameter portion of second cylinder body 21*b* and the inner diameter portion of third cylinder body 21*c*.

The first intermediate partition plate 16 and the second intermediate partition plate 17 have the thicknesses T1 and T2, respectively, along the axial direction of the sealed container 10. According to the present embodiment, the thickness T1 of the first intermediate partition plate 16 is greater than the thickness T2 of the second intermediate partition plate 17.

The first bearing 18 is located on the first cylinder body 21*a*. The first bearing 18 includes a flange portion 23 projecting out towards an inner surface of the circumferential wall 10*a* of the sealed container 10. The flange portion 23 is stacked on the upper surface of the first cylinder body 21*a* so as to cover the inner diameter portion of the first cylinder body 21*a* from above.

According to the present embodiment, the flange portion 23 of the first bearing 18 is surrounded by a ring-shaped support frame 24. The support frame 24 is fixed to a predetermined position of the inner surface of the circumferential wall 10*a* of the sealed container 10 by, for example, such means as welding or the like.

A lower surface of the support frame 24 is overlaid on an upper surface of an outer circumferential portion of the first cylinder body 21*a*. The outer circumferential portion of the first cylinder body 21*a* is jointed to the support frame 24 through a plurality of first fastening bolts 25 (only one is shown).

Further, the flange portion 23 of the first bearing 18, the first cylinder body 21*a*, the first intermediate partition plate 16 and the second cylinder body 21*b* are stacked on one another along the axial direction of the sealed container 10 and connected together as an integral body through a plurality of second fastening bolts 26 (only one is shown).

The second bearing 19 is located under the third cylinder body 21*c*. The second bearing 19 includes a flange portion 27 projecting out towards the inner surface of the circumferential wall 10*a* of the sealed container 10. The flange portion 27 is stacked on a lower surface of the third cylinder body 21*c* so as to cover an inner diameter portion of the third cylinder body 21*c* from below.

The flange portion 27 of the second bearing 19, the third cylinder body 21*c*, the second intermediate partition plate 17 and the second cylinder body 21*b* are stacked on one another along the axial direction of the sealed container 10 and connected together as integral body through a plurality of third fastening bolts 28 (only one is shown).

Therefore, the first bearing 18 and the second bearing 19 are spaced apart from each other along the axial direction of the sealed container 10 and also the first to third cylinder bodies 21*a*, 21*b* and 21*c*, the first intermediate partition plate 16 and the second intermediate partition plate 17 are alternately disposed between the first bearing 18 and the second bearing 19.

According to the embodiment, the zone surrounded by the inner diameter portion of first cylinder body 21*a*, the first intermediate partition plate 16 and the flange portion 23 of the first bearing 18 defines the first cylinder chamber 30.

The zone surrounded by the inner diameter portion of the second cylinder body 21*b*, the first intermediate partition plate 16 and the second intermediate partition plate 17 defines the second cylinder chamber 31.

Further, the zone surrounded by the inner diameter portion of third cylinder body 21*c*, the second intermediate partition plate 17 and the flange portion 27 of the second bearing 19 defines the third cylinder chamber 32.

As shown in FIG. 3, the thickness of the first intermediate partition plate 16 is set greater than that of the second intermediate partition plate 17, and with this structure, a distance D1 from an axial middle point of the first cylinder chamber 30 to an axial middle point of the second cylinder chamber 31 is greater than a distance D2 from an axial middle point of the second cylinder chamber 31 to an axial middle point of the third cylinder chamber 32.

In other words, the second intermediate partition plate 17 is thinner than the first intermediate partition plate 16, and thus the second cylinder chamber 31 and the third cylinder chamber 32 are maintained to be close to each other along the axial direction of the sealed container 10.

As shown in FIGS. 2 and 3, a first discharge muffler 33 is attached to the first bearing 18. Between the first discharge muffler 33 and the first bearing 18, a first silencer chamber 34 is formed. The first silencer chamber 34 is opened via a plurality of exhaust holes (not shown) made in the first discharge muffler 33 to inside of the sealed container 10.

A second discharge muffler 35 is attached to the second bearing 19. Between the second discharge muffler 35 and the second bearing 19, a second silencer chamber 36 is formed. The second silencer chamber 36 is communicated to the first silencer chamber 34 via a discharge passage (not shown) extending along the axial direction of the sealed container 10.

As shown in FIGS. 2 and 3, the rotary shaft 20 is located to be coaxial with the sealed container 10 on the central axis O1 thereof. The rotary shaft 20 is a single integrated structure including the first journal portion 38, the second journal portion 39, first to third the crank portions 40*a*, 40*b* and 40*c*, a first connection shaft 41 and a second connection shaft 42.

The first journal portion 38 is located in an axial middle portion of the rotary shaft 20 and is rotatably supported by the first bearing 18. The rotor 14 of the electric motor 11 is connected to an upper end portion of the rotary shaft 20 protruding out from the first bearing 18.

The second journal portion 39 is provided to be coaxial with the first journal portion 38 so as to be located in a lower end portion of the rotary shaft 20. The second journal portion 39 is rotatably supported by the second bearing 19.

Figure 4:
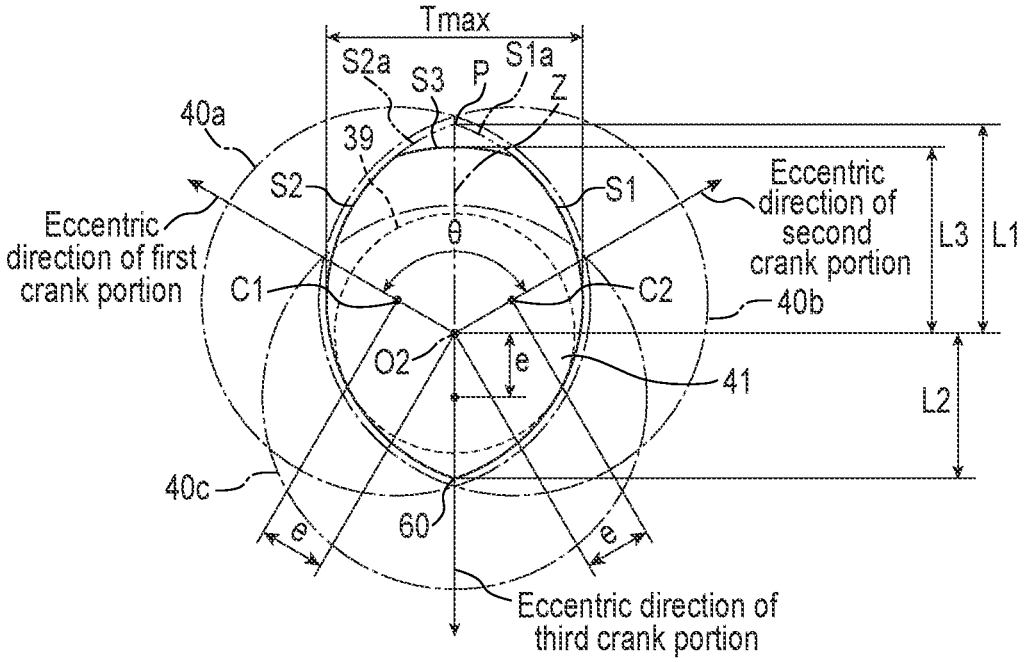
FIG. 4 is a diagram showing positions of a first crank portion, a second crank portion, a third crank portion and a first connection shaft with relative to each other as the axis of rotation is viewed from an axial direction.

The first to third crank portions 40*a*, 40*b* and 40*c* are located between the first journal portion 38 and the second journal portion 39 and are arranged along the axial direction of rotary shaft 20 with intervals therebetween. As shown in FIG. 4, the first to third crank portions 40*a*, 40*b* and 40*c* are disc-shaped elements each having a circular cross-section. In this embodiment, the axial thickness and diameter of the rotary shaft 20 are set to be the same as each other.

The first to third crank portions 40*a*, 40*b* and 40*c* are eccentric to a rotation center line O2 of the rotary shaft 20 which passes the center of rotation of the first journal portion 38 and the second journal portion 39. That is, as shown in FIG. 4, the eccentric directions of the first to third crank portions 40*a*, 40*b* and 40*c* with respect to the rotation center line O2 of the rotary shaft 20 are equally shifted in the circumferential direction of the rotary shaft 20.

Further, eccentricity amounts e of the first to third crank portions 40*a*, 40*b* and 40*c* with respect to the rotary center line O2 of the rotary shaft 20 are equal to each other.

As shown in FIG. 3, the first crank portion 40*a* is located in the first cylinder chamber 30. The second crank portion 40*b* is located in the second cylinder chamber 31. The third crank portion 40*c* is located in the third cylinder chamber 32.

The first connection shaft 41 is located between the first crank portion 40*a* and the second crank portion 40*b* and on a rotation center line O2 of the rotary shaft 20 and penetrates the through hole 16*a* of the first intermediate partition plate 16. The second connection shaft 42 is located between the second crank portion 40*b* and the third crank portion 40*c* and on the rotation center line O2 of the rotary shaft 20 and penetrates the through hole 17*a* of the second intermediate partition plate 17.

A ring-shaped roller 45 is engaged with an outer circumferential surface of the first crank portion 40*a*. The roller 45 follows the rotary shaft 20 so as to eccentrically rotate in the first cylinder chamber 30 and to bring a part of the outer circumferential surface of the roller 45 into contact slidably with an inner peripheral surface of an inner diameter portion of the first cylinder body 21*a*.

An upper end surface of the roller 45 is slidably in contact with a lower surface of the flange portion 23 of the first bearing 18. A lower end surface of the roller 45 is slidably in contact with an upper surface of the first intermediate partition plate 16. With this configuration, airtightness of the first cylinder chamber 30 is secured.

A ring-shaped roller 46 is engaged with an outer circumferential surface of the second crank portion 40*b*. The roller 46 follows the rotary shaft 20 so as to eccentrically rotate in the second cylinder chamber 31 and to bring a part of the outer circumferential surface of roller 46 slidably into contact with an inner peripheral surface of an inner diameter portion of the second cylinder body 21*b*.

An upper end surface of the roller 46 is slidably in contact with a lower surface of the first intermediate partition plate 16. A lower end surface of the roller 46 is slidably in contact with an upper surface of the second intermediate partition plate 17. With this configuration, airtightness of the second cylinder chamber 31 is secured.

A ring-shaped roller 47 is engaged with an outer circumferential surface of the third crank portion 40*c*. The roller 47 follows the rotary shaft 20 so as to eccentrically rotate in the third cylinder chamber 32 and to bring a part of the outer circumferential surface of the roller 47 slidably into contact with an inner peripheral surface of an inner diameter portion of the third cylinder body 21*c*.

An upper end surface of the roller 47 is slidably in contact with a lower surface of the second intermediate partition plate 17. A lower end surface of the roller 47 is slidably in contact with an upper surface of the flange portion 27 of the second bearing 19. With this configuration, airtightness of the third cylinder chamber 32 is secured.

According to this embodiment, the rollers 45, 46 and 47 have inner diameters greater than those of the first connection shaft 41 and the second connection shaft 42 of the rotary shaft 20.

Figure 6:
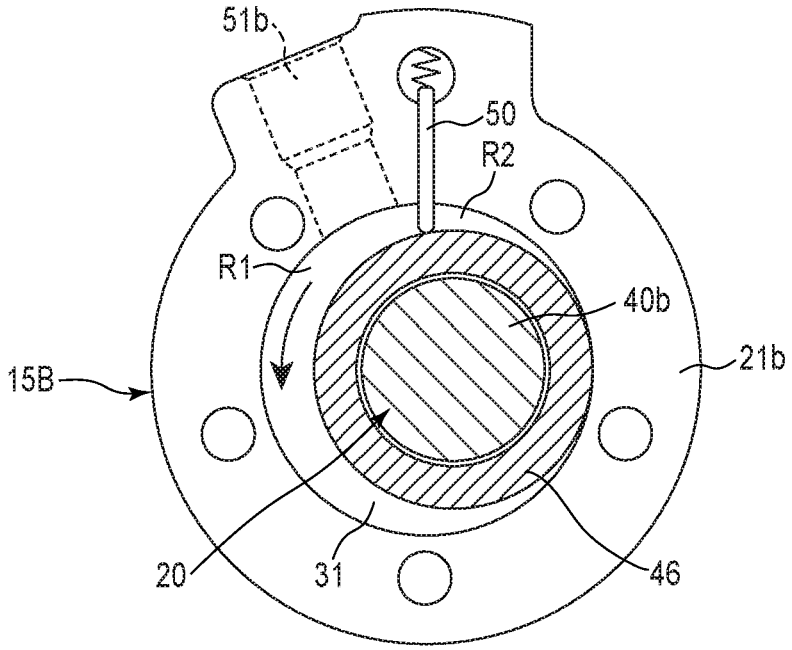
FIG. 6 is a cross section showing positions of a vane and a roller with relative to each other in the embodiment.

As shown in FIG. 6, which illustrates the second cylinder chamber 31 as a representative example, the first to the third cylinder chamber 30, 31 and 32 are each sectioned into a suction area R1 and a compression area R2 with a vane 50. With this configuration, when the rollers 45, 46 and 47 eccentrically rotate in the first to third cylinder chamber 30, 31 and 32, respectively, volumes of the suction area R1 and the compression area R2 of each of the cylinder chambers 30, 31 and 32 change.

A first connection opening 51*a* is formed inside of the first cylinder body 21*a* so as to be communicated to the suction area R1 of the first cylinder chamber 30. The first connection opening 51*a* is opened in a side surface of the first cylinder body 21*a*. A second connection opening 51*b* is formed inside of the second cylinder body 21*b* so as to be communicated to the suction area R1 of the second cylinder chamber 31. The second connection opening 51*b* is opened in a side surface of the second cylinder body 21*b*. Ends of the first and second connection openings 51*a* and 51*b* are arranged along the axial direction of the sealed container 10 with an interval therebetween.

As shown in FIG. 2, the cylindrical accumulator 8 is attached beside the sealed container 10 such as to stand perpendicularly. A bottom portion of the accumulator 8 is located near an upper end of the compression mechanism unit 12.

The accumulator 8 comprises a first suction pipe 52*a* and a second suction pipe 52*b* which distribute the vapor-phase refrigerant from which the liquid-phase refrigerant has been separated, to the first to third cylinder chamber 30, 31 and 32 of the compression mechanism unit 12. The first and second suction pipes 52*a* and 52*b* penetrate the bottom portion of the accumulator 8 and are led outside the accumulator 8.

The first suction pipe 52*a* is curved into an elbow shape towards a circumferential wall 10*a* of the sealed container 10 under the accumulator 8. A distal end portion of the first suction pipe 52*a* penetrates the circumferential wall 10*a* of the sealed container 10 and is connected to the first connection opening 51*a* of the first cylinder body 21*a*.

The second suction pipe 52*b* is greater in diameter than the first suction pipe 52*a* and is curved into an elbow shape towards the circumferential wall 10*a* of the sealed container 10 under the first suction pipe 52*a*. A distal end portion of the second suction pipe 52*b* penetrates the circumferential wall 10*a* of the sealed container 10 and is connected to the second connection opening 51*b* of the second cylinder body 21*b*.

The second intermediate partition plate 17 which partitions the second cylinder chamber 31 and the third cylinder chamber 32 from each other comprises a refrigerant distribution opening 53 communicated to the second connection opening 51*b* of the second cylinder body 21*b*. The refrigerant distribution opening 53 is communicated to the third cylinder chamber 32 via an introduction path 54 formed in the third cylinder body 21*c*.

Further, as shown in FIG. 3, a first discharge valve 56, which opens when the pressure of the compression area R2 of the first cylinder chamber 30 reaches a predetermined value, is provided in the flange portion 23 of the first bearing 18. A discharge side of the first discharge valve 56 is communicated to the first silencer chamber 34.

A second discharge valve 57, which opens when the pressure of the compression area R2 of the second cylinder chamber 31 reaches a predetermined value, is provided in the first intermediate partition plate 16. A discharge side of the second discharge valve 57 is communicated to the first silencer chamber 34 via a discharge path (not shown) provided inside the first intermediate partition plate 16 and inside the first cylinder body 21*a*.

A third discharge valve 58, which opens when the pressure of the compression area R2 of the third cylinder chamber 32 reaches a predetermined value, is provided in the flange portion 27 of the second bearing 19. A discharge side of the third discharge valve 58 is communicated to the second silencer chamber 36.

In 3-cylinder rotary compressor 2 with such a structure discussed above, when the rotary shaft 20 is rotated by the electric motor 11, the rollers 45, 46 and 47 follow the first to third crank portions 40*a*, 40*b* and 40*c* and eccentrically rotate in the first to third cylinder chambers 30, 31 and 32, respectively. Thus, volumes of the suction area R1 and the compression area R2 of each of the first to the third cylinder chambers 30, 31 and 32 change, and the vapor-phase refrigerant in the accumulator 8 is suctioned into the suction areas R1 of the first to third cylinder chamber 30, 31 and 32 from the first and second suction pipes 52*a* and 52*b*.

The vapor-phase refrigerant suctioned into the suction area R1 of the first cylinder chamber 30 from the first suction pipe 52*a* is gradually compressed in the process that the suction area R1 transforms to the compression area R2. At the point when the pressure of the vapor-phase refrigerant reaches a predetermined value, the first discharge valve 56 opens to discharge the vapor-phase refrigerant compressed by the first cylinder chamber 30 to the first silencer chamber 34.

A part of the vapor-phase refrigerant guided to the second connection opening 51*b* of the second cylinder body 21*b* from the second suction pipe 52*b* is suctioned into the suction area R1 of the second cylinder chamber 30. The remaining vapor-phase refrigerant guided to the second connection opening 51*b* is suctioned to the suction area R1 of the third cylinder chamber 31 via the refrigerant distribution opening 53 of the second intermediate partition plate 17 and the introduction path 54 of the third cylinder body 21*c*.

The vapor-phase refrigerant suction into the suction area R1 of the second cylinder chamber 31 is gradually compressed in the process that the suction area R1 transform to the compression area R2. At the time when the pressure of the vapor-phase refrigerant reaches a predetermined value, the second discharge valve 57 opens to guide the vapor-phase refrigerant compressed by the second cylinder chamber 31 to the first silencer chamber 34 through a discharge path.

The vapor-phase refrigerant suctioned into the suction area R1 of the third cylinder chamber 32 is gradually compressed in the process that the suction area R1 transforms to the compression area R2. At the time when the pressure of the vapor-phase refrigerant reaches a predetermined value, the third discharge valve 58 opens to discharge the vapor-phase refrigerant compressed by the third cylinder chamber 32 to the second silencer chamber 36. The vapor-phase refrigerant discharged to the second silencer chamber 36 is guided to the first silencer chamber 34 through a discharge path.

In this embodiment, the eccentric directions of the first to third crank portions 40*a*, 40*b* and 40*c* are equally shifted in the circumferential direction of the rotary shaft 20. Therefore, there is an equal phase difference in the timing that the vapor-phase refrigerant compressed in each of the first to third cylinder chambers 30, 31 and 32 is discharged.

The vapor-phase refrigerant portions compressed in the first to the third cylinder chambers 30, 31 and 32 join together in the silencer chamber 34 and then it is discharged continually to the inside of the sealed container 10 from an exhaust hole of the first discharge muffler 33. The vapor-phase refrigerant discharged to the inside of sealed container 10 passes the electric motor 11 and then is guided from the discharge pipe 10*b* to the four-way valve 3.

On the other hand, in the 3-cylinder rotary compressor 2, the rollers 45, 46 and 47 eccentrically rotate in the first to third cylinder chambers 30, 31 and 32 and thus the volumes of the suction area R1 and the compression area R2 of each of the cylinder chambers 30, 31 and 32 change, thereby compressing the vapor-phase refrigerant.

Thus, a load created by the pressure change in the first to third cylinder chamber 30, 31 and 32 is applied to the rotary shaft 20 which eccentrically rotates the rollers 45, 46 and 47, and therefore the torque fluctuation is not avoidable from occurring to the rotary shaft 20. The torque fluctuation may cause vibration and noise of the 3-cylinder rotary compressor 2, and therefore should be suppressed as much as possible.

Figure 7:
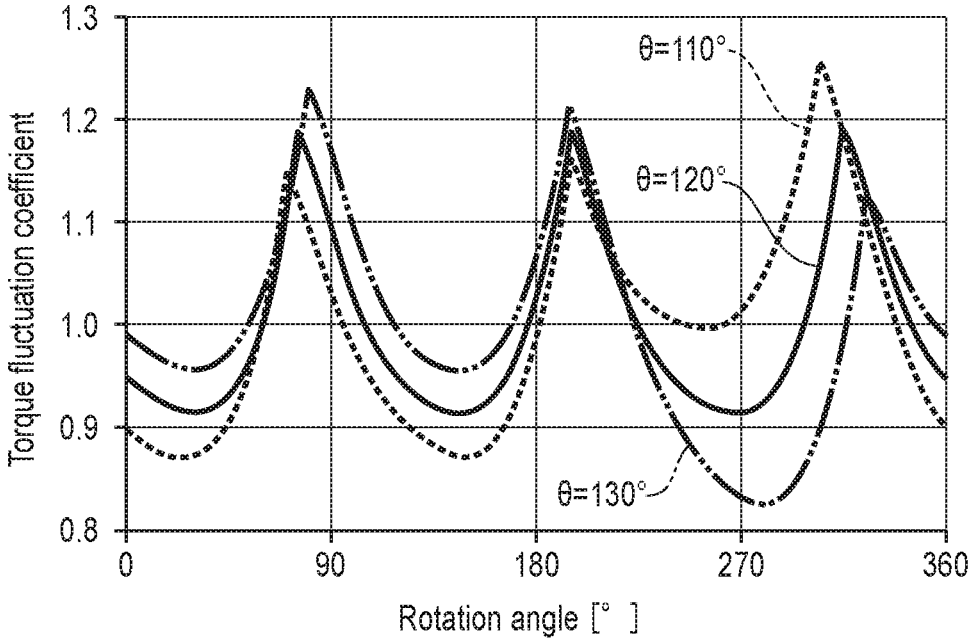
FIG. 7 is a characteristic diagram showing a coefficient of fluctuation in torque of the 3-cylinder rotary compressor when the phase angle θ of the eccentric direction of crank portions adjacent to each other is changed.

FIG. 7 is a characteristic diagram showing the torque fluctuation with respect to the rotation angle of the rotary shaft 20 when the angle difference θ of the eccentric direction of each of the first to third crank portions 40*a*, 40*b* and 40*c* of the rotary shaft 20 is set to 110°, 120° or 130°.

As shown in FIG. 7, the torque fluctuation coefficient at the time when the angle difference θ is 110° is 38.8%, the torque fluctuation coefficient at the time when the angle difference θ is 120° is 27.1% and the torque fluctuation coefficient at the time when the angle difference θ is 130° is 40.4%. Although not shown, the torque fluctuation coefficient at the time when the angle difference θ is 140° is 54.2%.

It is generally desired that the torque fluctuation coefficient of the rotary compressor should be 50% or less. Therefore, in this embodiment, the eccentric directions of the first to third crank portions 40*a*, 40*b* and 40*c* are shifted in the circumferential direction of the rotary shaft 20 with respect to the rotation center line O2 of the rotary shaft 20 within a range of 110° to 130° (120°±10°), and particularly, the angle difference θ should be 120°, at which the torque fluctuation coefficient becomes minimum.

According to this embodiment, the second suction pipe 52*b* communicated to the accumulator 8 is connected to the second cylinder body 21*b*, and thus the vapor-phase refrigerant compressed by the second cylinder chamber 31 of the second cylinder body 21*b* is discharged to the discharge path in the first intermediate partition plate 16.

Here, the first intermediate partition plate 16 partitioning the first cylinder chamber 30 and the second cylinder chamber 31 from each other is formed thicker than the second intermediate partition plate 17 partitioning the second cylinder chamber 31 and the third cylinder chamber 32 from each other, and therefore a sufficient volume can be secured for the discharge path in the first intermediate partition plate 16.

At the same time, the second discharge valve 57 is provided for the first intermediate partition plate 16 located on the second cylinder chamber 31, and with this configuration, the length of the path from the second cylinder chamber 31 to the exhaust hole of the first silencer chamber 34 located in an uppermost portion of the compression mechanism unit 12 is short. Therefore, together with the large volume of the discharge path in the first intermediate partition plate 16, a discharge loss of the vapor-phase refrigerant, which may occur until the vapor-phase refrigerant compressed by the second cylinder chamber 31 reaches the first silencer chamber 34, can be suppressed to an extremely low level.

Further, the second intermediate partition plate 17 interposed between the second cylinder chamber 31 and the third cylinder chamber 32 is thinner than the first intermediate partition plate 16, and with this configuration, the distance from the second cylinder body 21*b* to which the second suction pipe 52*b* is connected, to the third cylinder chamber 32 can be shortened. Therefore, a suction loss of the vapor-phase refrigerant, which may occur until the vapor-phase refrigerant guided from the second suction pipe 52*b* to the second connection opening 51*b* of the second cylinder body 21*b* reaches the third cylinder chamber 32 through the refrigerant distribution opening 53 of the second intermediate partition plate 17 and the introduction path 54 of the third cylinder body 21*c*, can be suppressed to an extremely low level.

In addition, the second suction pipe 52*b* is connected to the second cylinder body 21*b* located on the third cylinder body 21*c*. With this configuration, the entire length of the second suction pipe 52*b* connecting the accumulator 8 and the compression mechanism unit 12 to each other can be shortened. As a result, a suction loss, which may occur while the vapor-phase refrigerant passing through the second suction pipe 32*b* can be suppressed to an extremely low level.

Thus, despite the structure that the second cylinder chamber 31 and the third cylinder chamber 32 commonly use the only one second suction pipe 52*b*, the vapor-phase refrigerant returned from the accumulator 8 can be efficiently compressed by the second cylinder chamber 31 and the third cylinder chamber 32, and then discharged to the inside of the sealed container 10.

Next, the dimensions and shapes of the rotary shaft 20 and the roller 46 of the compression mechanism unit 12 will be described.

FIG. 4 shows the positions of the first crank portion 40*a*, second crank portion 40*b* and third crank portion 40*c* with relative to each other when viewing the rotary shaft 20 from the axial direction, and a shape of a cross section of the first connection shaft 41 taken along a direction normal to the rotation center line O2 of the rotary shaft 20.

As shown in FIG. 4, a center C1 of the first crank portion 40*a* is shifted by an eccentricity amount e with respect to the rotation center line O2 of the rotary shaft 20. Similarly, a center C2 of the second crank portion 40*b* is shifted by the eccentricity amount e to an opposite side to the eccentric direction of the first crank portion 40*a* with respect to the rotation center line O2 of the rotary shaft 20.

In this embodiment, the first connection shaft 41 provided over between the first crank portion 40*a* and the second crank portion 40*b* penetrates the first intermediate partition plate 16, which is thicker than the second intermediate partition plate 17, the length of the shaft thereof is longer than that of the second connection shaft 42.

Thus, the first connection shaft 41 is formed such that the cross sectional shape thereof taken along the direction normal to the rotation center line O2 of the rotary shaft 20 has approximately a leaf shape such as shown in FIG. 4, thereby securing a sufficient rigidity. More specifically, the first connection shaft 41 comprises a first outer surface S1, a second outer surface S2 and a third outer surface S3.

The first outer surface S1 is located on an opposite side to the eccentric direction of the first crank portion 40*a* with respect to the rotation center line O2 of the rotary shaft 20 and is slightly shifted to the side of the rotation center line O2 of the rotary shaft 20 as compared to the outer circumferential surface of the first crank portion 40*a*. Further, the first outer surface S1 is constituted by a cylindrical surface coaxial with the center C1 of the first crank portion 40*a* and a radius of the first outer surface S1 is greater than a radius of the first journal portion 38 and that of the second journal portion 39.

The second outer surface S2 is located on an opposite side to the eccentric direction of the second crank portion 40*b* with respect to the rotation center line O2 of the rotary shaft 20 and is slightly shifted to the side of the rotation center line O2 of the rotary shaft 20 as compared to the outer circumferential surface of the second crank portion 40*b*. Further, the second outer surface S2 is constituted by a cylindrical surface coaxial with the center C2 of the second crank portion 40*b* and a radius of the second outer surface S2 is greater than a radius of the first journal portion 38 and that of the second journal portion 39.

In this embodiment, one circumferential end of the first outer surface S1 and one circumferential end of the second outer surface S2 are formed to abut to each other, thus defining an edge portion 60 extending in the axial direction of the first connection shaft 41. The edge portion 60 can as well be referred to as an intersecting point between one end of the first outer surface S1 and one end of the second outer surface S2.

The third outer surface S3 is provided across between the first outer surface S1 and the second outer surface S2 on an opposite side to the edge portion 60 while interposing the rotation center line O2 of the rotary shaft 20 therebetween. That is, as shown in FIG. 4, when an imaginary extended line S1*a* obtained by extending the first outer surface S1 and an imaginary extended line S2*a* obtained by extending the second outer surface S2 cross each other at an intersecting point P, the third outer surface S3 is constituted by a cylindrical surface located between the intersecting point P and the rotation center line O2 of the rotary shaft 20 and coaxial with the rotation center line O2 of the rotary shaft 20.

The intersecting point P is located at one end of the approximately leaf shape along a direction of long shaft Z, which defines the cross sectional shape of the first connection shaft 41. Further, the edge portion 60 as the intersecting point is located in the other end the approximately leaf shape along the direction of the long shaft Z, which defines the cross sectional shape of the first connection shaft 41.

When, as shown in FIG. 4, a distance from the intersecting point P located at one end of the approximately leaf shape along the direction of the long shaft Z to the rotation center line O2 of the rotary shaft 20 is represented by L1, a distance from the edge portion (intersecting point) 60 located at the other end of the long shaft Z to the rotation center line O2 of the rotary shaft 20 is represented by L2, and a distance from the third outer surface S3 to the rotation center line O2 of the rotary shaft 20 is represented by L3, L1, L2 and L3 satisfy the following relationship:

$$L1>L3\geq L2.$$

In this embodiment, the angle difference θ between the eccentric directions of the first crank portion 40*a* and the second crank portion 40*b* is set to 1200, and thus a difference is created between L1 and L2 described above. Therefore, if, for example, the first connection shaft 41 is formed only by the first outer surface S1 and the second outer surface S2, the center of the first connection shaft 41 is eccentric by that difference from the rotation center line O2 of the rotary shaft 20. When the center of the first connection shaft 41 is eccentric, the position of the center of gravity of the connection shaft 41 is shifted off from the rotation center line O2 of the rotary shaft 20, and therefore the rotary shaft 20 is unbalanced.

However, the first connection shaft 41 of this embodiment comprises the third outer surface S3 provided across between the first outer surface S1 and the second outer surface S2 and the third outer surface S3 is located between the intersecting point P and the rotation center line O2. Therefore, the position of the center of gravity of the first connection shaft 41 can be moved to the side of the rotation center line O2 of the rotary shaft 20.

Note that the rigidity of the first connection shaft 41 is increased when setting L3 slightly greater than L2.

Furthermore, with an angle difference θ of 120°, the width dimension Tmax of the first connection shaft 41 crossing normal to the direction of the long shaft Z of the first connection shaft 41 can be increased as compared to the case where the angle difference θ is set to 180°.

Figure 5A:
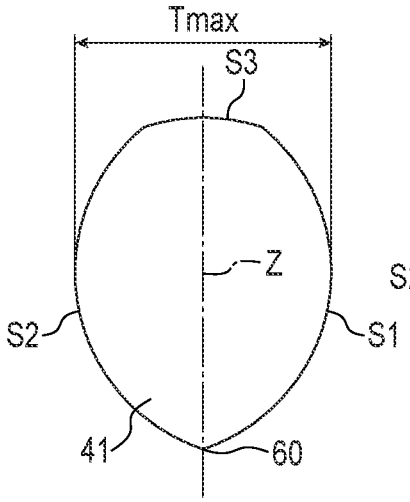
FIG. 5(A) is a diagram showing a maximum thickness Tmax of the first connection shaft when an angle difference θ between the first crank portion and the second crank portion with respect to an eccentric direction is set to 120°.
Figure 5B:
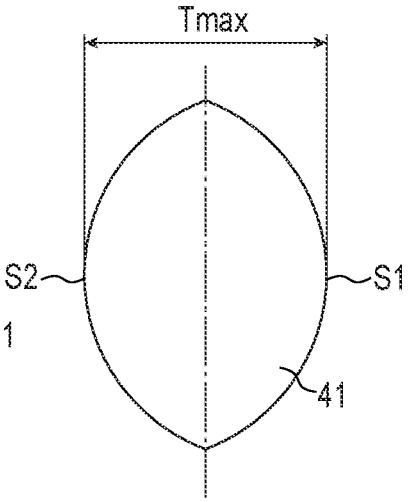
FIG. 5(B) is a diagram showing a maximum thickness Tmax of the first connection shaft when an angle difference θ between the first crank portion and the second crank portion with respect to an eccentric direction is set to 180°.

FIG. 5(A) shows the width dimension Tmax of the first connection shaft 41 when the angle difference θ is set to 120°. FIG. 5(B) shows the width dimension Tmax of the first connection shaft 41 when the angle difference θ is set to 180°. When the diameter of the first crank portion 40*a*, the diameter of the second crank portion 40*b*, the diameters and eccentricity amount e of the first outer surface S1 and the second outer surface S2 of the connection shaft 41 are set constant, the width dimension Tmax of the first connection shaft 41 can be increased more when the angle difference θ is set to 120°, and accordingly, the rigidity of the first connection shaft 41 can be improved.

As seen in FIG. 3, according to this embodiment, a distance D3 from the middle point of the rotary shaft 20 along the axial direction of the second crank portion 40*b* to the axial middle point of the third crank portion 40*c* is less than the distance D2 from the axial middle point of the second cylinder chamber 31 to the axial middle point of the third cylinder chamber 32.

A distance D4 from the middle point of the rotary shaft 20 along the axial direction of the first crank portion 40*a* to the axial middle point of the second crank portion 40*b* is greater than the distance D1 from the axial middle point of the first cylinder chamber 30 to the axial middle point of the second cylinder chamber 31.

Figures 8A, 8B, 8C, 8D:
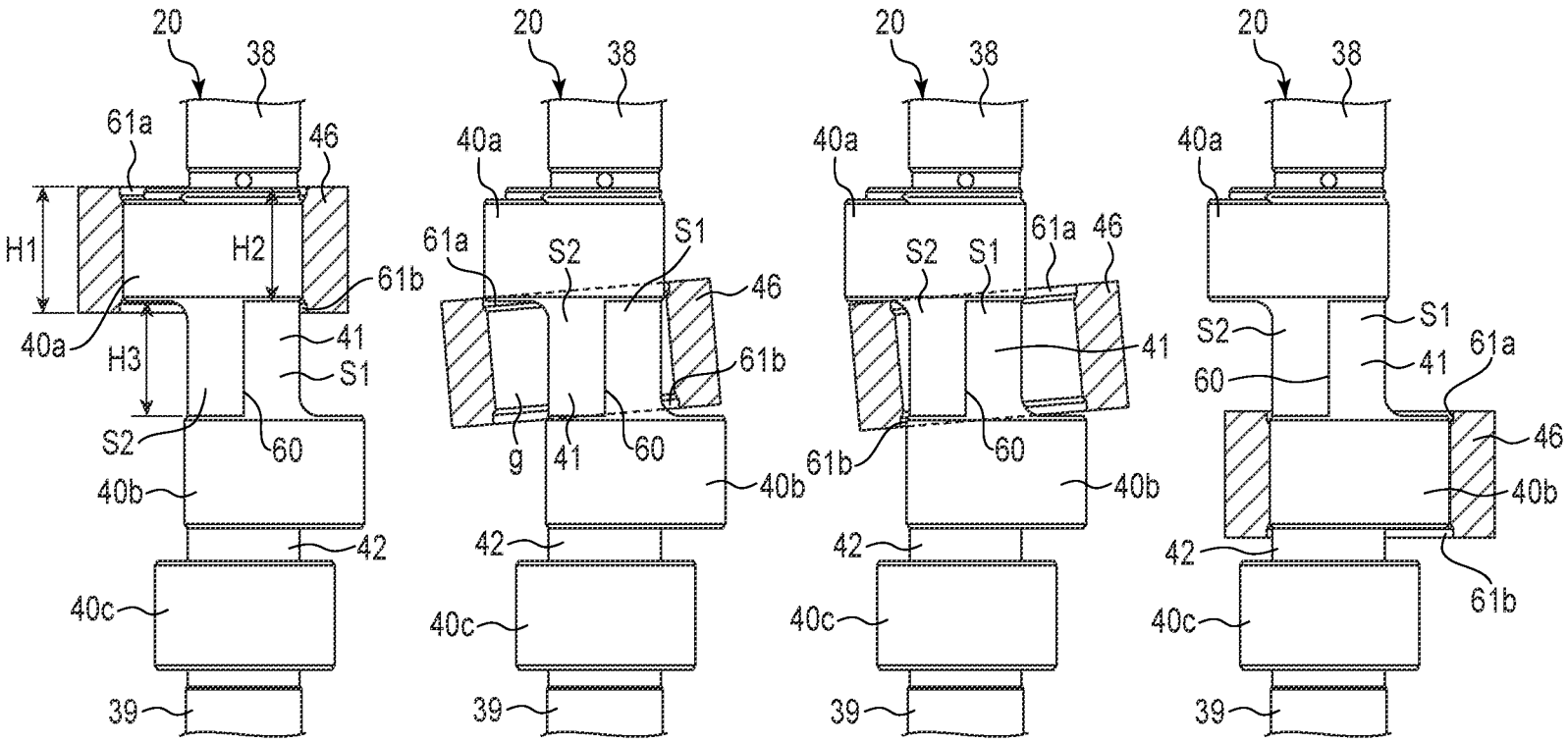
FIG. 8(A) is a cross section showing a state that a roller corresponding to the second crank portion is guided to an outer circumferential surface of the first crank portion from a first journal portion.
FIG. 8(B) is a cross section showing a state that a roller corresponding to the second crank portion is inclined on an outer side of the first connecting shaft.
FIG. 8(C) is a cross section showing a state that the roller corresponding to the second crank portion is moved in the diametrical direction of the rotary shaft at a position of the first connecting shaft.
FIG. 8(D) is a cross section showing a state that a roller is engaged to the outer circumferential surface of the second crank portion.

Further, as shown in FIG. 8(A), an axial length H1 the rollers 45, 46 and 47 to be engaged with the first to third crank portions 40*a*, 40*b* and 40*c*, respectively is greater than an axial length H2 of the first to third crank portions 40*a*, 40*b* and 40*c*. In addition, the axial length H1 of the rollers 45, 46 and 47 is greater than the axial length H3 of the first connection shaft 41 of the rotary shaft 20.

According to this embodiment, the first outer surface S1 of the first connection shaft 41 is slightly moved over to the side of the rotation center line O2 of the rotary shaft 20 as compared to the outer circumferential surface of the first crank portion 40*a*. Similarly, the second outer surface S2 of the first connection shaft 41 is slightly moved over to the rotation center line O2 of the rotary shaft 20 as compared to the outer circumferential surface of the second crank portion 40*b*. With this configuration, the roller 46 to be engaged with the outer circumferential surface of the second crank portion 40*b* can be guided from a first crank portion 40*a* side to the second crank portion 40*b* through the outer side of the first connection shaft 41.

Here, the axial length H1 of the roller 46 is greater than the length H3 of the first connection shaft 41, the lower end surface of the roller 46 abuts against the upper end surface of the second crank portion 40*b* when the roller 46 having passed the first crank portion 40*a* reaches the outer side of the first connection shaft 41. Therefore, it is difficult to move the roller 46 from the first connection shaft 41 to the direction of the second crank portion 40*b* as it is.

To solve this, in this embodiment, chamfers 61*a* and 61*b* are provided respectively on both opening edges formed along the axial direction of the inner diameter portion of the roller 46. With the chamfers 61*a* and 61*b*, the roller 46 has such a shape that the opening edges thereof are cut over the entire circumferences diagonally along a direction to increase the inner diameter.

Note that in this embodiment, all of the rollers 45, 46 and 47 are common parts, and therefore similar chamfers 61*a* and 61*b* are also provided in opening edges of the inner diameter portions of the other rollers 45 and 47.

Next, the operation of attaching the roller 46 to the outer circumferential surface of the second crank portion 40*b* of the rotary shaft 20 will be described with reference to FIG. 8. FIG. 8(A) to FIG. 8(D) show work processing steps in order for attaching the roller 46 to the outer circumferential surface of the second crank portion 40*b* through the outer side of the first connection shaft 41 from the first crank portion 40*a*.

FIG. 8(A) shows a state where the roller 46 inserted from the side of the first journal portion 38 of the rotary shaft 20 is moved to the outer side of the first crank portion 40*a*. The roller 46 comprises the chamfers 61*a* and 61*b* in the opening edges of the inner diameter portion. With this configuration, when moving the roller 46 from the first journal portion 38 to the direction of the first crank portion 40*a*, it is possible to avoid the opening edges of the inner diameter portion of the roller 46 from interfering with the outer circumferential surface of the first crank portion 40*a*. Thus, the roller 46 can be moved easily from the first journal portion 38 towards the first crank portion 40*a*.

FIG. 8(B) shows a state where the roller 46 is moved from the first crank portion 40*a* to the outer side of the first connection shaft 41. In this embodiment, the first outer surface S1 of the first connection shaft 41 is slightly moved to the side of the rotation center line O2 of the rotary shaft 20 as compared to the outer circumferential surface of the first crank portion 40*a*. With this configuration, when moving the roller 46 to the outer side of the first connection shaft 41 from the first crank portion 40*a*, it is possible to avoid the inner diameter portion of the roller 46 from interfering with the first outer surface S1.

Here, the axial length H1 of the roller 46 is greater than the length H3 of the first connection shaft 41, and therefore if the roller 46 is moved to the outer side of the first connection shaft 41, the lower end surface of the roller 46 abuts against the upper end surface of the second crank portion 40*b*, and further the upper end surface of the roller 46 protrude slightly upward from the lower end surface of the first crank portion 40*a*.

Under these circumstances, it is difficult to move the roller 46 from the first connection shaft 41 to the direction of the second crank portion 40*b*. In this embodiment, the chamfers 61*a* and 61*b* are formed in the opening edges of the inner diameter portion of the roller 46. With this configuration, at the point when the roller 46 reaches the outer side of the first connection shaft 41, the roller 46 is inclined to the rotary shaft 20 as shown in FIG. 8(B).

Thus, a part of the inner diameter portion of the roller 46, which faces the second outer surface S2 of the first connection shaft 41 is located lower than the first crank portion 40*a*, and further a gap g is created between the inner circumferential surface of the inner diameter portion of the roller 46 and the second outer surface S2 of the first connection shaft 41. Furthermore, an outer circumferential edge of the first crank portion 40*a*, which is located on the side of the first connection shaft 41 enters the chamfered portion 61*a* of the roller 46.

FIG. 8(C) shows a state where the roller 46 inclined in an outer side of the first connection shaft 41 is moved in a diametrical direction of the rotary shaft 20. The roller 46 moves to such a direction that the inner circumferential surface of the inner diameter portion thereof approaches the second outer surface S2 of the first connection shaft 41, and a part of the upper end surface of the roller 46 enters below the first crank portion 40*a*. At the same time, an outer circumferential edge of the second crank portion 40*b*, which is located on the side of the first connection shaft 41 enters the chamfered portion 61*b* of the roller 46. As a result, the roller 46 is located right above the second crank portion 40*b* in the outer side of the first connection shaft 41.

FIG. 8(D) shows a state where the roller 46 is moved to the second crank portion 40*b* from the first connection shaft 41. When the inclination of the roller 46 is straightened while a part of the upper end surface of the roller 46 entering below the first crank portion 40*a*, the roller 46 and the second crank portion 40*b* can be aligned to be coaxial with each other.

With this configuration, when the roller 46 is moved to the second crank portion 40*b* from the side of the first connection shaft 41, the state changes to engage the roller 46 with the outer circumferential surface of the second crank portion 40*b*.

According to the first embodiment, the angle difference θ between the eccentric directions of the first crank portion 40*a* and the second crank portion 40*b* is set within a range of 110° to 130° (120°±10°). With this setting, it is possible to secure a sufficient width dimension Tmax of the first connection shaft 41 while suppressing the torque fluctuation of the rotary shaft 20. Thus, the area of the cross section of the first connection shaft 41 along the direction normal to the axial direction of the rotary shaft 20 is increased.

Further, the length H3 of the first connection shaft 41 is less than the axial length H1 of the roller 46. Therefore, together with the increase in the area of the cross section of the first connection shaft 41, the rigidity of the first connection shaft 41 formed across between the first crank portion 40*a* and the second crank portion 40*b* can be strengthened.

As a result, wobbling of the shaft of the rotary shaft 20, which may occur during the operation of the 3-cylinder rotary compressor 2 can be suppressed and the vibration and noise of the 3-cylinder rotary compressor 2 can be suppressed to a low level.

Further, the first connection shaft 41 has a cross sectional shape defined by the first outer surface S1, the second outer surface S2 and the third outer surface S3, the position of the center of gravity of the first connection shaft 41 can be moved as much as possible to the side of the rotation center line O2 of the rotary shaft 20.

Therefore, the rotary shaft 20 is well balanced and in this respect as well, wobbling of the shaft of the rotary shaft 20 can be suppressed, thus contributing to the reduction of the vibration of the 3-cylinder rotary compressor 2.

According to this embodiment, the first outer surface S1 of the first connection shaft 41 is constituted by a cylindrical surface coaxial with the center C1 of the first crank portion 40*a* and the second outer surface S2 is constituted by a cylindrical surface coaxial with the center C2 of the second crank portion 40*b*. With this structure, the rigidity of the first connection shaft 41 can be raised while enabling the roller 46 to be engaged with the outer circumferential surface of the second crank portion 40*b* guided to the second crank portion 40*b* through the outer side of the first connection shaft 41 from the direction of the first crank portion 40*a*.

In addition, the third outer surface S3 of the first connection shaft 41 is constituted by a cylindrical surface coaxial with the first journal portion 38 of the rotary shaft 20. With this structure, when the first crank portion 40*a*, the second crank portion 40*b* and the first journal portion 38 are subjected to a cutting process using, for example, a lathe, the first outer surface S1, the first outer surface S2 and the third outer surface S3 each can be cut by the same process.

Therefore, the workability for the rotary shaft 20 is improved and accordingly, the production cost of the rotary shaft 20 can be reduced.

In this embodiment, in consideration of the workability in the installation of the roller 46, the first outer surface S1 is moved to the side of the rotation center line O2 of the rotary shaft 20 as compared to the outer circumferential surface of the first crank portion 40*a*, and also the second outer surface S2 is formed in a position close to the rotation center line O2 of the rotary shaft 20 as compared to the outer circumferential surface of the second crank portion 40*b* in the partial position. However, the embodiments are not limited to this structure.

For example, the first outer surface S1 may be formed on the same surface as that of the outer circumferential portion of the first crank portion 40*a*, and the second outer surface S2 may be formed on the same surface as that of the outer circumferential surface of the second crank portion 40*b*.

According to this embodiment, the distance D4 from the middle point of the rotary shaft 20 along the axial direction of the first crank portion 40*a* to the axial middle point of the second crank portion 40*b* is greater than the distance D1 from the axial middle point of the first cylinder chamber 30 to the axial middle point of the second cylinder chamber 31.

With this configuration, while moving the roller 46 from the direction of the first crank portion 40*a* towards the second crank portion 40*b* through the outer side of the first connection shaft 41, it is difficult for the roller 46 to be caught on the first connection shaft 41. Thus, the roller 46 can be moved easily, and the workability for installing the roller 46 on the rotary shaft 20 can be improved.

Further, in this embodiment, the distance D3 from the middle point of rotary shaft 20 along the axial direction of the second crank portion 40*b* to the axial middle point of the third crank portion 40*c* is less than the distance D2 from the axial middle point of the second cylinder chamber 31 to the axial middle point of the third cylinder chamber 32. With this configuration, if the compression of the vapor-phase refrigerant may cause deformation of the rotary shaft 20 from the first bearing 18 and the second bearing 19 as starting points, the bending stress acting on the rotary shaft 20 can be reduced.

As a result, wobbling of the shaft of the rotary shaft 20, regional abrasion of the rollers 46 and 47, and degradation in the sealing performance, which may be caused by being brought into contact with the shaft, can be prevented, thereby making it possible to obtain a high-performance and high-reliability 3-cylinder rotary compressor 2.

In the embodiment, the third outer surface S3 of the first connection shaft 41 is provided on a longitudinal one side of the substantially leaf shape with respect to the rotation center line O2 of the rotary shaft 20. However, the present embodiments are not limited to such a configuration. For example, a pair of third outer surfaces S3 each constituted by a cylindrical surface coaxial with the first journal portion 38 may be provided to respective longitudinal end portions of the first connection shaft 41, and the edge portion 60 may be omitted.

In addition, the first outer surface S1 and the second outer surface S2 of the first connection shaft 41 need not necessarily be curved into an arc shape over the entire circumference. It suffices if at least an intermediate portion of the first outer surface S1 and an intermediate portion of the second outer surface S2, which define Tmax, are curved in an arc shape.

Further, the embodiment is discussed in connection with examples of a general type rotary compressor, in which the vane follows eccentric rotation of the roller and reciprocate to advance to the cylinder chamber and retract to the direction away from the cylinder chamber, but the embodiment are similarly applicable to the so-called swing-type rotary compressor in which, for example, a vane integrally projects outwards from the outer circumferential surface of the roller in the diametrical direction.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary compressor comprising:

a rotary shaft including a first journal portion supported by a first bearing, a second journal portion provided coaxial with the first journal portion and supported by a second bearing, first to third crank portions provided between the first journal portion and the second journal portion, arranged along an axial direction of the journal portions with intervals respectively therebetween and having circular cross sectional shapes whose eccentric directions are shifted in a circumferential direction of the journal portions, a first connection shaft provided across between the first crank portion and the second crank portion, and a second connection shaft provided across between the second crank portion and the third crank portion, which are integrated as one body, eccentric directions of adjacent pairs of the crank portions being shifted with respect to a rotation center of the journal portions in a circumferential direction within a range of 120°±10°;

ring-like rollers engaged with outer circumferential surfaces of the first to third crank portions, respectively;

a first cylinder body accommodating the respective roller engaged with the first crank portion, and the respective roller defining a first cylinder chamber which eccentrically rotates with the first crank portion;

a second cylinder body accommodating the respective roller engaged with the second crank portion, and the respective roller defining a second cylinder chamber which eccentrically rotates with the second crank portion;

a third cylinder body accommodating the respective roller engaged with the third crank portion, and the respective roller defining a third cylinder chamber which eccentrically rotates with the third crank portion;

a first intermediate partition plate interposed between the first cylinder body and the second cylinder body, in which a first connection shaft of the rotary shaft penetrates; and a second intermediate partition plate interposed between the second cylinder body and the third cylinder body, in which a second connection shaft of the rotary shaft penetrates, the rotary compressor wherein:

the first connection shaft of the rotary shaft has a cross sectional shape comprising:

a first outer surface formed in a position same as an outer circumferential surface of the first crank portion located on an opposite side to the eccentric direction of the first crank portion or a position shifted to a side of the rotation center of the rotary shaft as compared to the outer circumferential surface, at least a middle portion thereof being formed into an arc shape;

a second outer surface formed in a position same as an outer circumferential surface of the second crank portion located on an opposite side to the eccentric direction of the second crank portion or a position shifted to a side of the rotation center of the rotary shaft as compared to the outer circumferential surface, at least a middle portion thereof being formed into an arc shape; and a third outer surface formed across between the first outer surface and the second outer surface in a position shifted from the rotation center of the rotary shaft, and when, in a cross section normal to the axial direction of the rotary shaft of the first connection shaft, L1 represents a distance from an intersecting point located on one end side where the first outer surface and the second outer surface intersect each other when the first outer surface and the second outer surface are extended, to the rotation center of the rotary shaft, L2 represents a distance from an intersecting point located on an other end side where the first outer surface and the second outer surface intersect each other, to the rotation center of the rotary shaft, and L3 represents a maximum distance from the third outer surface to the rotation center of the rotary shaft, a relationship of $L1>L3\geq L2$ is satisfied.

2. The rotary compressor of claim 1, wherein:

the first outer surface of the first connection shaft is constituted by a circular arc surface coaxial with the first crank portion, the second outer surface of the first connection shaft is constituted by a circular arc surface coaxial with the second crank portion, and the third outer surface of the first connection shaft is constituted by a circular arc surface coaxial with the rotation center of the rotary shaft.

3. The rotary compressor of claim 2, wherein:

a distance from an axial middle point of the first crank portion to an axial middle point of the second crank portion is greater than a distance from an axial middle point of the first cylinder chamber to an axial middle point of the second cylinder chamber.

4. The rotary compressor of claim 1, wherein:

a distance from an axial middle point of the first crank portion to an axial middle point of the second crank portion is greater than a distance from an axial middle point of the first cylinder chamber to an axial middle point of the second cylinder chamber.

5. The rotary compressor of claim 1, wherein:

an axial length of the first connection shaft is less than an axial length of the respective roller to be engaged with the outer circumferential surface of the second crank portion;

the respective roller corresponding to the second crank portion has an inner diameter greater than the first connection shaft, and chamfered portions are formed by cutting in opening edges located on respective axial ends of the inner diameter portion of the roller so as to avoid an outer circumferential edge of the first crank portion and an outer circumferential edge of the second crank portion; and the outer circumferential edge of the first crank portion and the outer circumferential edge of the second crank portion enter the chamfered portions, respectively, when the respective roller corresponding to the second crank portion is inclined while being guided to an outer side of the first connection shaft through an outer side of the first crank portion.

6. The rotary compressor of claim 1, wherein:

the first intermediate partition plate is formed thicker than the second intermediate partition plate.

7. The rotary compressor of claim 6, further comprising:

a first connection opening opened in a circumferential surface of the first cylinder body so as to be communicated to the first cylinder chamber, a first suction pipe being communicated to an accumulator being connected to the first connection opening; and a second connection opening opened in a circumferential surface of the second cylinder body so as to be communicated to the second cylinder chamber, a second suction pipe being communicated to the accumulator being connected to the second connection opening;

and wherein:

the second connection opening is communicated to the third cylinder chamber via a refrigerant distribution opening provided in the second intermediate partition plate.

8. The rotary compressor of claim 7, wherein:

a distance from an axial middle point of the second crank portion to an axial middle point of the third crank portion is less than a distance from an axial middle point of the second cylinder chamber to an axial middle point of the third cylinder chamber.

9. The rotary compressor of claim 6, wherein:

a distance from an axial middle point of the second crank portion to an axial middle point of the third crank portion is less than a distance from an axial middle point of the second cylinder chamber to an axial middle point of the third cylinder chamber.

10. A refrigeration cycle apparatus comprising:

a circulation circuit in which a refrigerant circulates, and to which a radiator, an expansion device and a heat absorber are connected;

the rotary compressor of claim 1 connected to the circulation circuit between the radiator and the heat absorber.

* * * * *